US005850700A

United States Patent [19]

Capson et al.

[11] Patent Number: 5,850,700

[45] Date of Patent: Dec. 22, 1998

[54] EYE ALIGNMENT APPARATUS FOR ARCHERY

[76] Inventors: Ronald Capson, 747 W. U.S. Hwy. 26, Blackfoot, Id. 83221; James Sherman, P.O. Box 333, Lewiston, Id. 83501

[21] Appl. No.: 694,515

[22] Filed: Aug. 9, 1996

[51] Int. Cl.[6] ..... F41G 1/467

[52] U.S. Cl. ..... 33/265

[58] Field of Search ..... 33/265, 286; 124/87

[56] References Cited

U.S. PATENT DOCUMENTS

| | | | |
|---|---|---|---|
| 2,909,167 | 10/1959 | Fredrickson | 33/265 |
| 3,410,644 | 11/1968 | McLendon | 33/265 |
| 3,641,675 | 2/1972 | Funk, Jr. | 33/265 |
| 4,272,191 | 6/1981 | Bergkvist | 33/286 |
| 4,662,347 | 5/1987 | Carlton | 33/265 |
| 4,977,678 | 12/1990 | Sears . | |
| 4,982,503 | 1/1991 | Land . | |
| 4,986,001 | 1/1991 | Giamattei | 33/265 |
| 5,025,565 | 6/1991 | Stenerson et al. . | |
| 5,040,300 | 8/1991 | Sheffield . | |
| 5,040,301 | 8/1991 | Forbis . | |
| 5,201,122 | 4/1993 | Annuziata | 33/265 |
| 5,201,124 | 4/1993 | Sherman | 33/265 |
| 5,253,423 | 10/1993 | Sullivan, Jr. et al. . | |
| 5,255,440 | 10/1993 | Rogers | 33/265 |
| 5,305,728 | 4/1994 | Young et al. . | |
| 5,339,227 | 8/1994 | Jones | 33/265 |
| 5,341,791 | 8/1994 | Shafer | 33/265 |
| 5,388,336 | 2/1995 | Pomaville | 33/265 |
| 5,454,169 | 10/1995 | Keller . | |
| 5,938,420 | 3/1995 | Kleinschmidt . | |

*Primary Examiner*—G. Bradley Bennett

*Attorney, Agent, or Firm*—Wells, St. John, Roberts Gregory & Matkin, P.S.

[57] ABSTRACT

Disclosed is an eye alignment apparatus which mounts on the bow and allows the archer to properly position the archer's eye with the bow and the aiming indicia, if any, otherwise mounted on the bow. The eye alignment apparatus includes a framework, a lens, a second alignment indicia on or near the lens, and a first alignment indicia spaced apart from the second alignment indicia. Additional features include a level indicator and an angular adjustment mounting mechanism.

6 Claims, 12 Drawing Sheets

EYE ALIGNMENT APPARATUS FOR ARCHERY

TECHNICAL FIELD

This invention generally pertains to an eye alignment apparatus for use in archery, more particularly, an apparatus which assures that the archer's shooting eye is consistently and accurately located relative to the bow and the sight pins.

BACKGROUND OF THE INVENTION

There are numerous variables which affect the accuracy of each archer and which effect each shot an archer makes. Most archers use sight pins as their sighting indicia or aiming indicia. The sight pins are mounted on the bow as aiming indicia to assist in aiming or directing the path of the arrow, and there are typically one to four sight pins. The respective sight pins will be set for different distances to allow that the arrow will fall more on longer shots than on shorter shots.

However, as the sight pins are typically in a fixed location relative to the bow, the alignment of the shot can vary dramatically depending on where the archer positions his or her head, or more particularly, his or her shooting eye. If the archer's eye position varies from shot to shot, so will the accuracy and direction of each respective shot, leading to inconsistent or unpredictable shooting.

In order to address this widely recognized problem, devices referred to as peep sights have become the predominant way for archers to attempt to consistently position their heads. Peep sights are small devices which attach to the draw string on the bow and attempt to give the archer a consistent reference from which to position his or her eye.

However, there are numerous accuracy problems associated with mounting peep sights to a draw string. First of all, the archer's shooting eye needs to be in the same location for each shot when the draw string on the bow is fully drawn and the archer is aiming or ready to release the draw string. This causes numerous potential inconsistent head positions for the archer due to: the draw string not being drawn the same exact distance each time; the draw string can be at different tensions for several reasons, such as being set differently, temperature differences and changes in elasticity over time, each of which affect the position of the peep sight; during low light conditions, a peep sight reduces or restricts the amount of light entering the archer's eye and makes it hard to simultaneously use the peep sight and see the target; and the draw string typically rotates as it is drawn.

Despite the numerous well-recognized problems with the peep sight and its inaccuracies, it continues to be the predominant eye alignment device in archery. The peep sight is however the weak link in archery sighting and aiming systems, leading to less accurate shooting.

It is an object of this invention to provide an alignment apparatus which allows an archer to much more accurately and consistently position and align his or her shooting eye with the bow and the sighting or aiming indicia on the bow. This invention accomplishes this object by providing the combination of a lens and one or two alignment indicia, which must be aligned before the archer is assured that his or her shooting eye is properly located and aligned. Properly locating and/or aligning the shooting eye means positioning it at a predetermined approximate angle relative to the lens and the first alignment indicia or relative to the lens, the first alignment indicia and the second alignment indicia.

It is a further object of this invention to provide such an alignment apparatus which does not depend on the draw string for its position or accuracy and which is not mounted thereon. This invention accomplishes this object by directly or indirectly mounting on the bow or on another device which is secured to the bow.

It is a still further object of this invention to provide such an alignment apparatus which allows the archer to very accurately position his or her head relative to the bow and/or the sighting indicia used to aim the bow. This is accomplished by utilizing a lens on the eye alignment apparatus on the side nearest the archer. The lens would typically have a focal length and a magnification, either or both of which can be utilized to achieve the accuracy objective.

The use of magnification and/or focal length in a lens in a compact eye alignment apparatus features high accuracy equivalent to that which only very long and cumbersome non-lens devices can achieve.

It is a yet a further object of this invention to provide such an alignment apparatus which includes adjustable mounts to a bow and with a level indicator. This invention discloses an integral level and an adjustable mount to adjust the angle of the eye alignment apparatus to varied terrain and angles of shoot.

BRIEF DESCRIPTION OF THE DRAWINGS

Preferred embodiments of the invention are described below with reference to the accompanying drawings, which are briefly described below.

FIG. 4 is section 4—4 from FIG. 3;

FIG. 17 is a perspective view of one example of how the eye alignment apparatus contemplated by this invention, can be mounted within a bow;

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Many of the fastening, connection and other means and components utilized in this invention are widely known and used in the field of the invention described, their exact nature or type is not necessary for an understanding and use of the invention by a person skilled in the art or science, and they will not therefor be discussed in significant detail. Furthermore, the various components shown or described herein for any specific application of this invention can be varied or altered as anticipated by this invention and the practice of a specific application of any element may already be widely known or used in the art or by persons skilled in the art or science and each will not therefor be discussed in significant detail.

Figure 1:
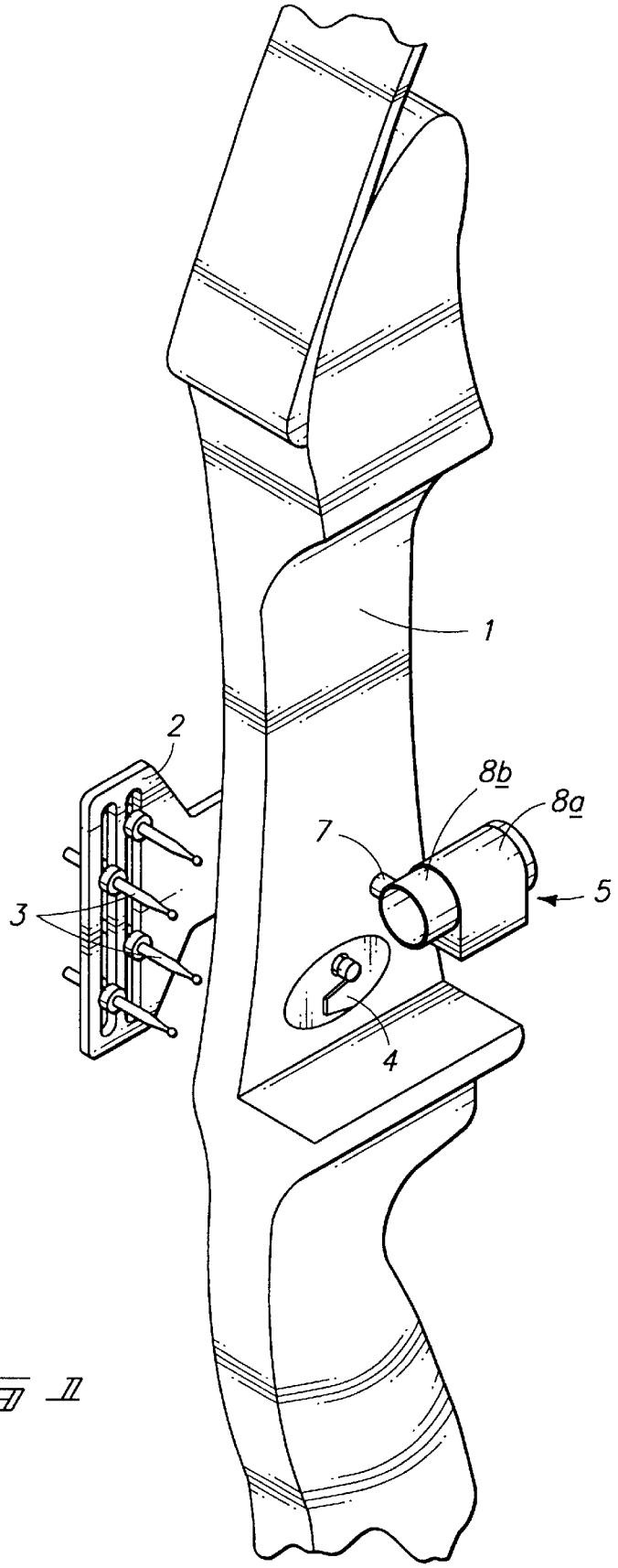
FIG. 1 is a perspective view of one example of the eye alignment apparatus contemplated by this invention, mounted on a bow.

The eye alignment apparatus 5 contemplated by this invention is not used as sighting or aiming indicia or as a substitute therefore, but instead is only contemplated to be used in combination with sighting indicia or aiming indicia, such as the sight pins 3 illustrated in FIG. 1. In the examples of embodiments of this invention illustrated herein, the archer cannot discernably see through the eye alignment apparatus to use it as a sighting or aiming indicia.

FIG. 1 illustrates one example of an eye alignment apparatus 5 contemplated by this invention. FIG. 1 shows a typical archery bow 1, a known arrow rest 4, with typical sight pins 3 utilized as aiming indicia, mounted on a sight framework 2, which is attached to the bow 1.

Figure 9:
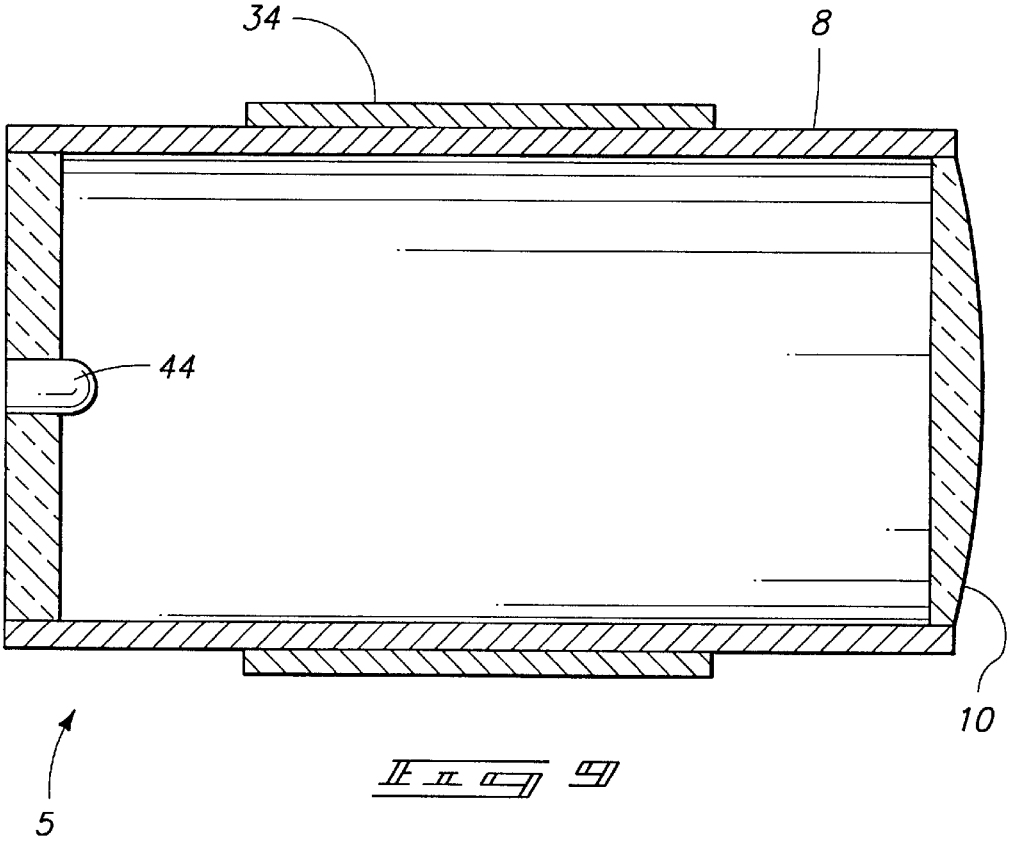
FIG. 9 is an alternative section view of the eye alignment apparatus, only which includes a light emitting diode as an alignment indicia.

The framework 8 for this invention can be any one of a number of different configurations and parts within the contemplation of this invention, such as the two piece configuration shown in FIG. 1, the one tubular piece shown in FIG. 9, or any one of numerous other possibilities. Framework as used herein, can be many different configurations and sizes, one piece or section, or a plurality of sections, with no one being required by this invention. The framework can be several pieces, or it can be a single tubular framework as illustrated in FIG. 9 and discussed more fully below.

Furthermore, the invention defines different components mounted to the framework 8, and as used herein, mounted, as used herein, such as mounted to the framework, is used in its broadest sense, which would include directly mounted by any means or mechanism or indirectly mounted such that it is mounted or attached to one or more intermediate components which are in turn mounted or attached to the framework 8.

The eye alignment apparatus 5 is shown attached to or mounted on archery bow 1 with mount screw 7 attached to framework section 8*a*. Framework section 8*b* can be attached to framework section 8*a* by glue, screw or numerous other attachment means.

Figure 2:
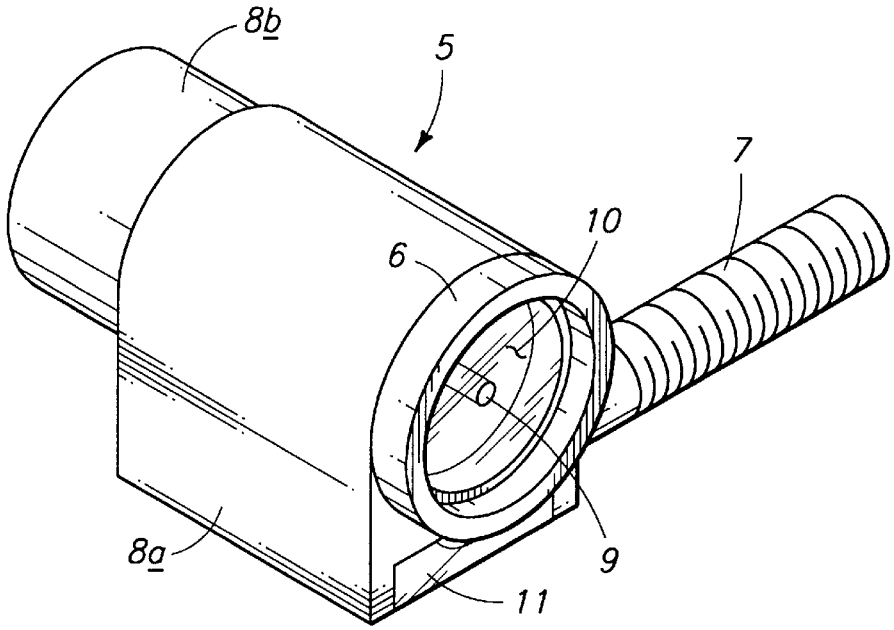
FIG. 2 is a perspective view of one example of the eye alignment apparatus contemplated by this invention.

FIG. 2 further illustrates one example of the eye alignment apparatus 5 contemplated by this invention, showing framework section 8*a*, framework section 8*b*, mount screw 7, lens 10, fluorescent fiber 9, lens mount 6 and level 11.

There are likewise numerous ways within the contemplation of this invention by which the eye alignment apparatus 5 can be mounted to the archery bow 1, such as by mount screw 7. Utilizing mount screw 7 allows the archer to adjust and locate the eye alignment apparatus 5 along the longitudinal axis of the mount screw 7, and locking screws or other mechanisms can then be used to secure it at its desired adjusted location.

For ease of assembly, the lens 10 is mounted in lens mount 6, which can then be mounted to the framework section 8*a*. A second alignment indicia in this example appears circular to the archer and is a fluorescent fiber 9 embedded in, or near to the lens 10.

The florescent fiber 9 is typically a polymer or plastic material which contains a fluorescent dye, generally referred to in the trade as LISA plastics (LISA is a registered trademark of Bayer AG), which is well known in the art. The LISA plastics having the LISA dye therein generally receive light through the side surfaces and into the interior of the body of the sight pin. Once inside the body of the sight, the light is internally reflected and re-directed such that the light is transmitted longitudinally even though it was received transversely.

Framework section 8*b* can likewise be attached to framework section 8*a* in any one of a number of different ways within the contemplation of the invention, but in this example glues to and becomes integral therewith. In this example, the first alignment indicia is mounted within or attached to the framework section 8*b*. The first alignment indicia can be any one of numerous indicia, but in this example, simple film with a circle 24 contained on the film is shown.

In the preferred embodiment of the invention, a thirteen and one-half millimeter diameter lens with a twenty six millimeter focal length is used, and the first alignment indicia is spaced approximately ninety-two one-hundredths of an inch from the back surface of the lens.

Figure 3:
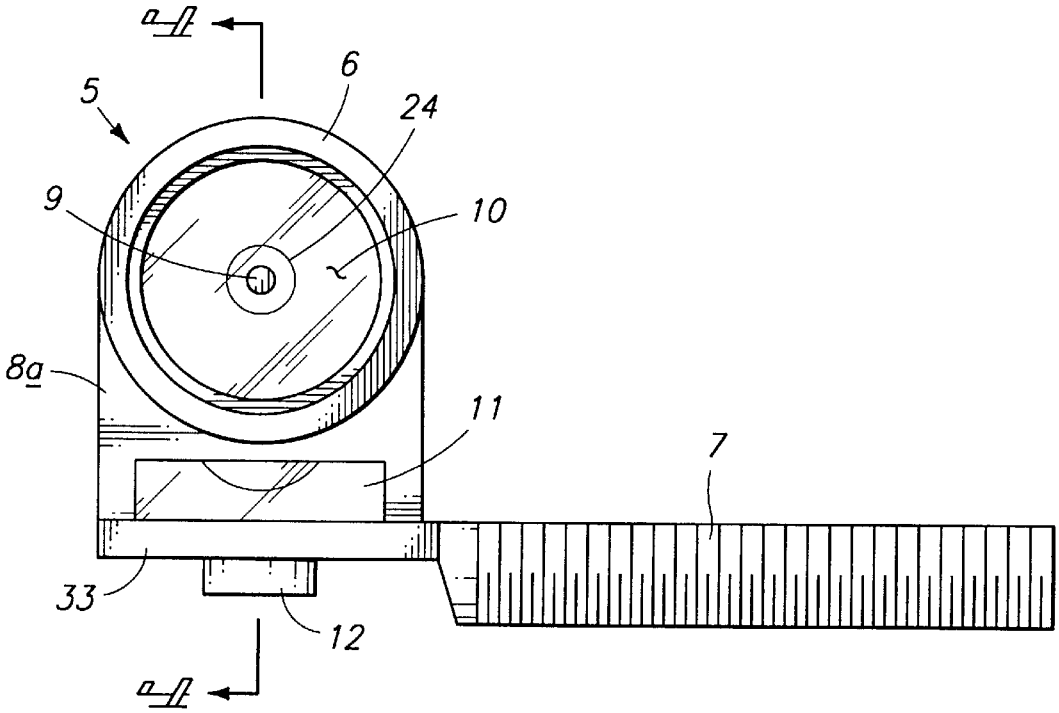
FIG. 3 is a front view of one example of the eye alignment apparatus contemplated by this invention.

FIG. 3 shows a front view of the example of the eye alignment apparatus 5 shown in FIG. 2, showing a circle 24 as the first alignment indicia, a fluorescent fiber 9 as the second alignment indicia, mount screw 7, level 11, lens 10, lens mount 6 and framework section 8*a*. The eye alignment apparatus 5 can be attached to mount screw 7 by mounting the eye alignment apparatus 5 on flange 33 attached to mount screw 7 and secured thereto by screw 12.

A lens 10 within the contemplation of this invention is an important component and there are endless possibilities of different types and specifications of lens 10 which can be used. Furthermore, there is more than one way to utilize a lens 10 to achieve the high accuracy objectives of this invention. A typical lens has convex or concave curvature on both of its sides, with the specific configuration of the lens variables, i.e. the radii of curvature of the respective surfaces, the index of refraction and the thickness of the lens, determining its characteristics, such as its focal length and magnification.

Additionally, in manipulating the radii of curvature of the respective surfaces, the index of refraction and the thickness of the lens, other results may be achieved. By way of example, increasing the curvature, i.e. decreasing the radii of curvature, of the surface of the lens, along with other variables, can result in the situation in which the first reference indicia is blurry or un-focused when viewed by a human eye which is not in the proper or desired location or at the predetermined approximate angle.

Therefore an alternative embodiment of this invention is the use of a lens 10 and only one alignment indicia instead of the preferred two alignment indicia. In this alternative embodiment, the lens 10 would be located nearest the archer and between the archer and the first alignment indicia. This would result in the first alignment indicia, which is spaced apart from the lens 10, being positioned such that it can only be viewed through the lens 10 from one approximate angle.

In other words, if the archer's eye is in a certain position or looking through the lens 10 at particular angle, the archer can see the first alignment indicia. Whereas if the archer is at a different angle or location, the archer's eye does not see the first alignment indicia. Therefore as used herein, the term "approximate angle" as used herein, is meant to include the exact angle and all surrounding or proximate angles from which the archer's eye can see the first reference indicia.

Similarly, a lens 10 configuration could be used wherein the only way that a part or all of the first alignment indicia would come into focus to the archer is if the archer's eye is positioned at the predetermined approximate angle. Conversely, if the archer's eye is not positioned at the approximate angle, part of all of the first alignment indicia would either be not visible or would not be in focus, or both.

In the embodiment of this invention wherein two alignment indicia are utilized, the relation of the first alignment indicia, the lens 10 and the second alignment indicia are such that the first alignment indicia and the second alignment indicia can only be viewed or seen in the predetermined way from the predetermined approximate angle. The predetermined way in which the first alignment indicia and the second alignment indicia are to be seen will be dependant upon the particular type and/or configuration of first reference indicia and/or second reference indicia used, some examples of which are shown in FIG. 13 through FIG. 16. For example, if a larger and a smaller circle are used as the first and second alignment indicia, the predetermined way in which the two are to be viewed may be with the small circle appearing within the large circle or centered within the large circle.

FIG. 4 is section 4—4 from FIG. 3 and illustrates fluorescent fiber 9, lens 10, lens mount 6, framework section 8*a*, framework section 8*b*, and film 13. Film 13 would include the first alignment indicia in whatever form it is, such as the second circle of larger diameter as illustrated in FIG. 3. FIG. 4 further illustrates that lens mount 6 and framework section 8*b* are attached to framework section 8*a*, by gluing it thereto.

Figure 5:
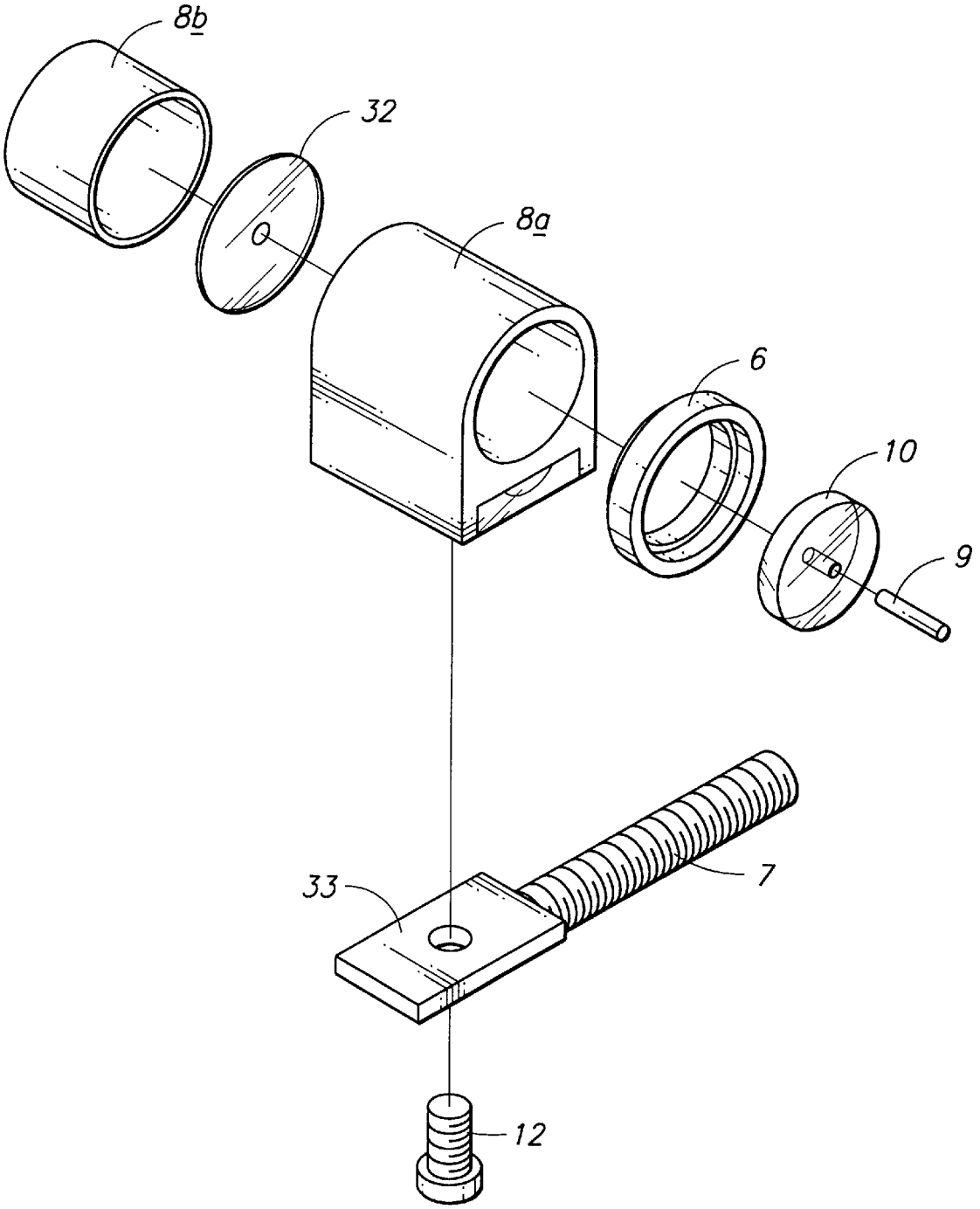
FIG. 5 is an perspective view of an exploded view of one example of the eye alignment apparatus contemplated by this invention.

FIG. 5 shows one example of the eye alignment apparatus 5 exploded to illustrate one way to accomplish the invention. Framework section 8*b* attaches to framework section 8*a* with film 32 interposed between the two framework sections. The film 32 need not be between framework section 8*b* and framework section 8*a*, but instead can be at the terminal end of framework section 8*b*.

FIG. 5 also illustrates the mount screw 7 with flange 33, through which bolt 12 passes and attaches to framework section 8*a*. Lens 10 receives the fluorescent fiber 9 and is mounted within lens mount 6, which is mounted to framework section 8*a*.

Figure 6:
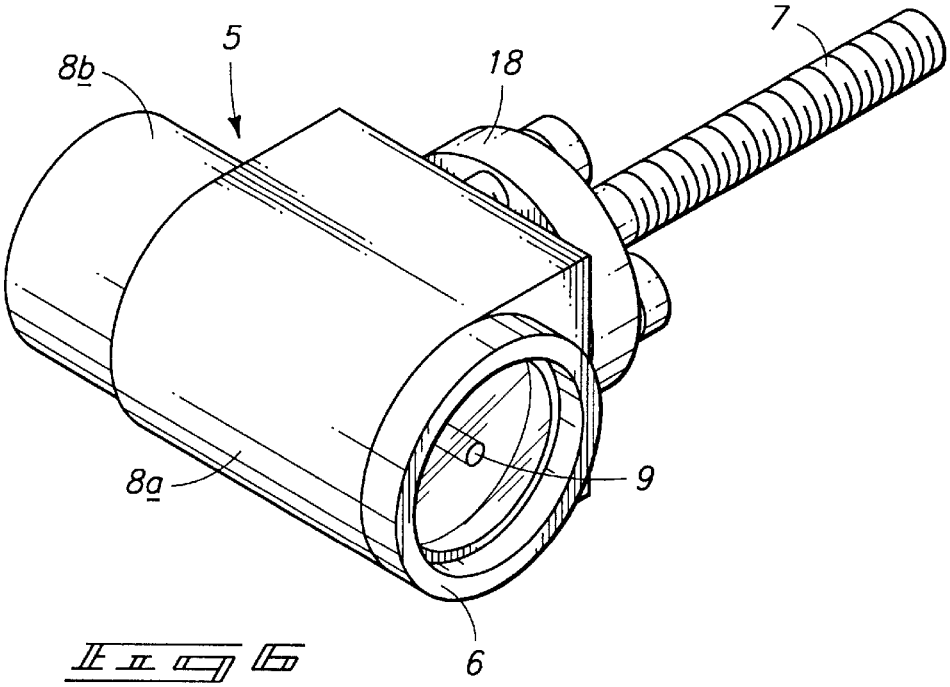
FIG. 6 is a perspective view of one example of the eye alignment apparatus contemplated by this invention.
Figure 7:
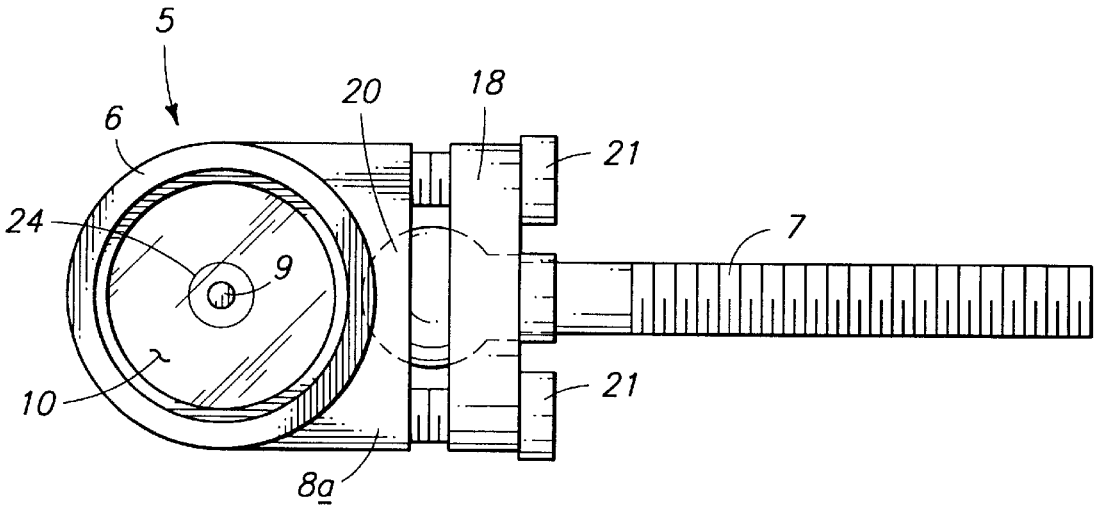
FIG. 7 is a front view of one example of the eye alignment apparatus contemplated by this invention.

FIG. 6 illustrates an example of the eye alignment apparatus 5 which can be adjustably mounted to the bow 1 through screw mount 7, and FIG. 7 further illustrates the way in which the mount is accomplished. Screw mount 7 terminates in a spherical mount ball 20. The eye alignment apparatus 5 has a spherical cavity opening corresponding in size to the spherical mount ball 20, as does mount block 18. Mount ball 20 is mounted within the corresponding cavities within the eye alignment apparatus 5 and the mount block 18, and screws 21 tighten the mount block 18 around the spherical mount ball 20. The screws 21 are adjusted tight enough such that the eye alignment apparatus 5 may be angularly adjusted by the archer, but which do not freely slip around.

Figure 8:
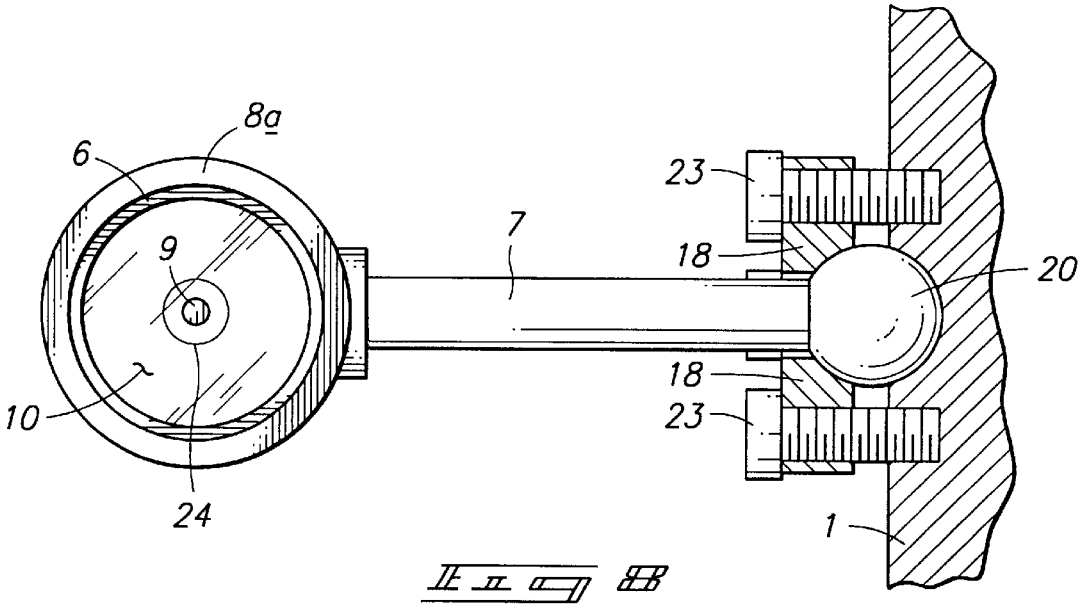
FIG. 8 is a front view of one example of the eye alignment apparatus contemplated by this invention attached to a bow and as viewed by the archer.

FIG. 8 illustrates an example of the eye alignment apparatus 5 which is adjustably attached to the bow 1, but wherein the spherical mount ball 20 is located between the mount block 18 and the archery bow 1. The mount block 18 is secured to the bow 1 around the spherical mount ball 20 with screws 23.

FIG. 9 is an alternative section view of the eye alignment apparatus 5, only which includes a light emitting diode ("LED") 44 as the first alignment indicia. FIG. 9 is further a depiction of an eye alignment apparatus 5 in which there is only one alignment indicia, in this example the LED 44, and the lens 10 can be designed or configured such that the LED 44 can only be seen through the lens 10 when the archer's eye is positioned at the predetermined approximate angle.

Similarly, the lens 10 could be configured such that part or all of a first alignment indicia can only be seen in focus to the archer's eye if the archer's eye is positioned at the predetermined approximate angle. In this example, it would probably be preferable that the first alignment indicia not be an LED 44, but instead be one of the configurations illustrated in FIG. 13 through FIG. 16.

Figure 10:
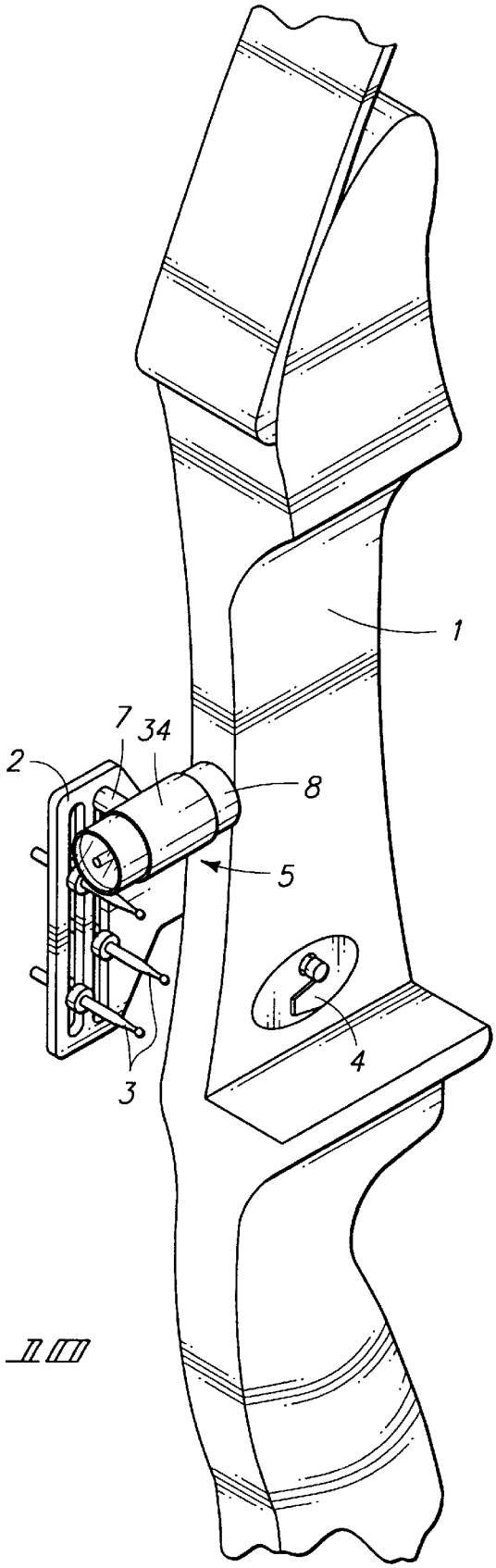
FIG. 10 is a perspective view of another example of the eye alignment apparatus contemplated by this invention, mounted on a bow and which illustrates a fluorescent fiber as an alignment indicia.
Figure 11:
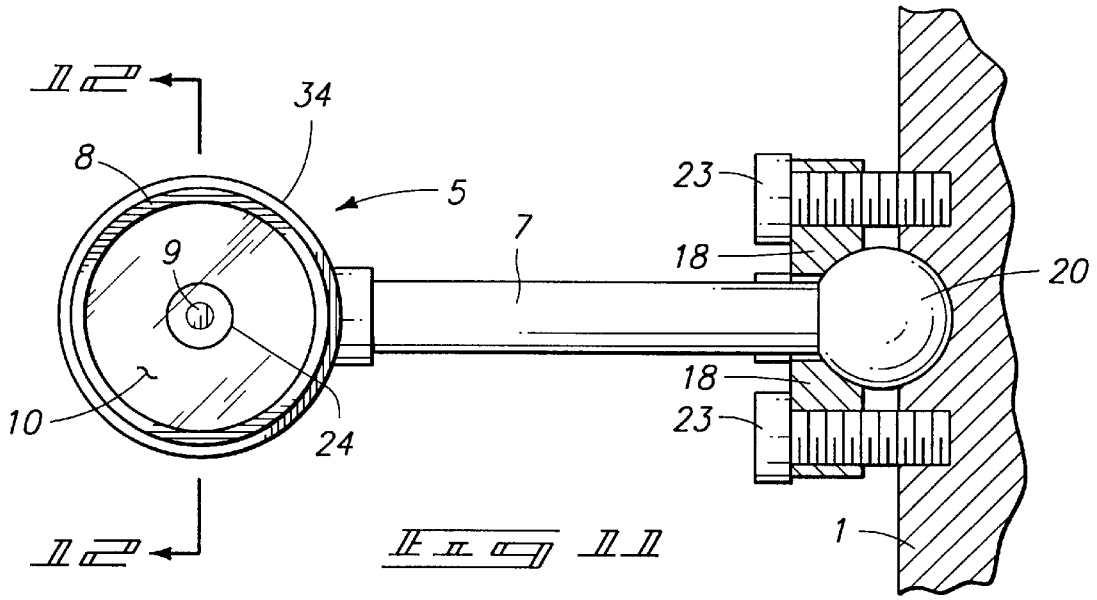

FIG. 10 is a perspective view of another example of the eye alignment apparatus 5 contemplated by this invention, mounted on a bow 1 and which illustrates a fluorescent fiber 9 as the first alignment indicia. The framework 8 is mounted to the sighting indicia framework 2 by clamp 34 and screw mount 7, which in turn is mounted to the bow 1. The eye alignment apparatus 5 can also be mounted to a framework dedicated to it, which can be similar to the sighting indicia framework 2.

FIG. 10 illustrates another example of an eye alignment apparatus 5 in which the framework 8 is a simple tube of suitable material, with lens 10 mounted therein. The eye alignment apparatus 5 is simply attached to mount screw 7 by clamp 34. In this example or illustration, the first alignment indicia would typically be attached to the framework 8 at the end of the framework 8, opposite lens 10.

Figure 11:
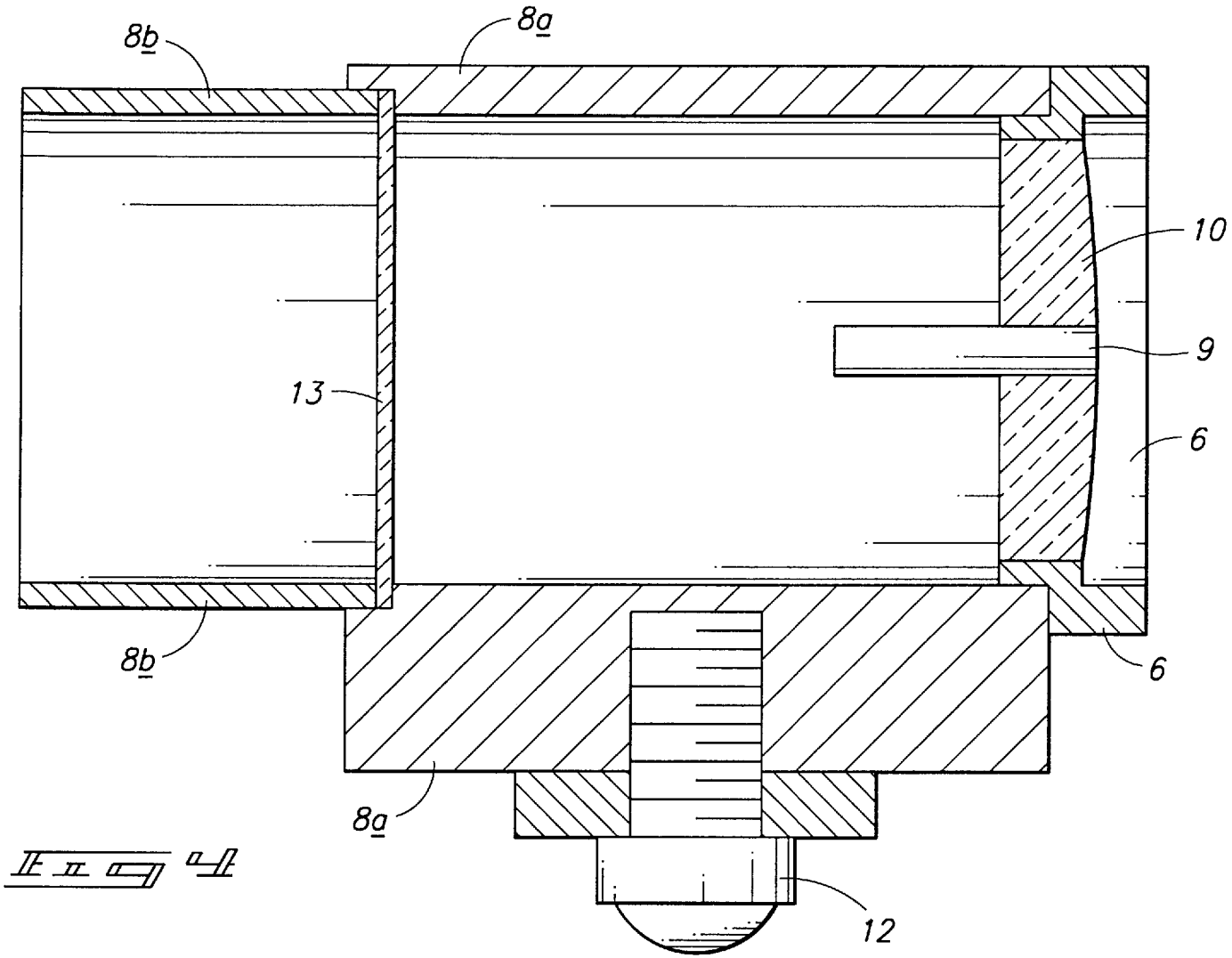
FIG. 11 is a front view of another example of the eye alignment apparatus contemplated by this invention as shown in FIG. 10, only wherein the framework is a tube and the fluorescent fiber alignment indicia is on the side of the apparatus away from the archer.

FIG. 11 is a front view of the example of the eye alignment apparatus 5 shown in FIG. 10, wherein the framework 8 is tubular and the lens is between the first alignment indicia, which is a fluorescent fiber 9, and the archer. The mounting clamp 34 is attached to the mount screw 7, similar to the example shown in FIG. 8.

Figure 12:
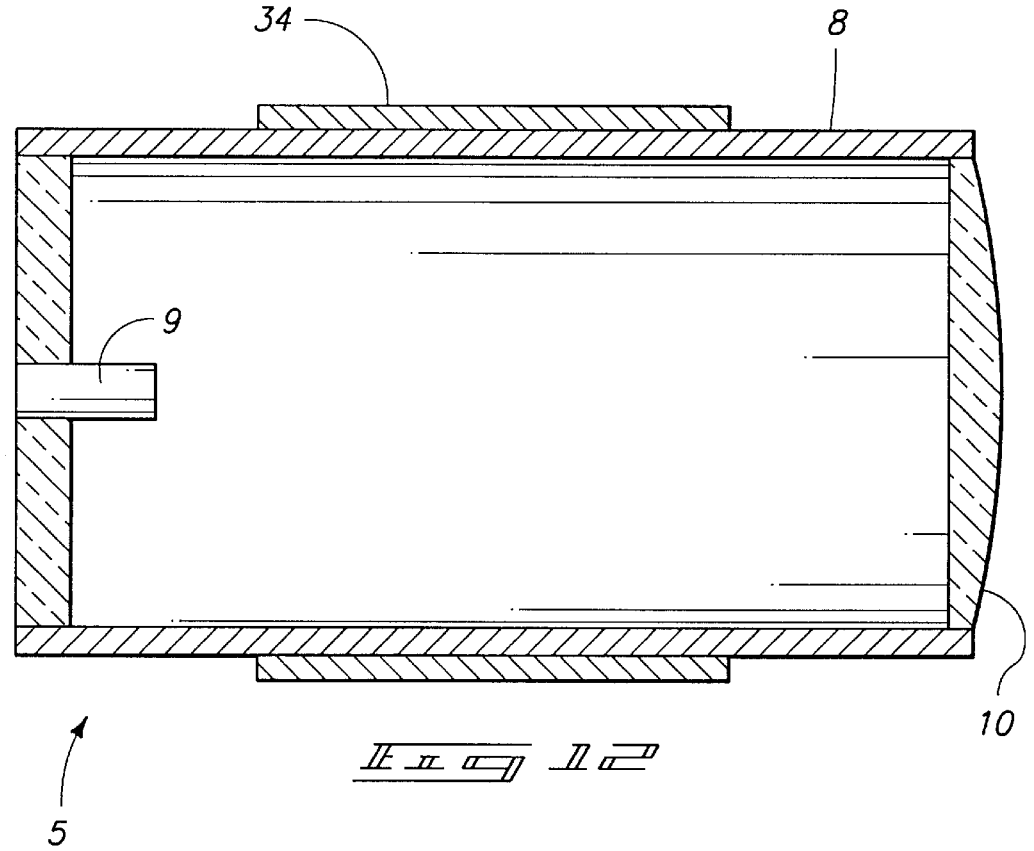
FIG. 12 is section 12—12 from FIG. 11.

FIG. 12 is section 12—12 from FIG. 11 and illustrates a simple tube as the framework 8, with lens 10 mounted to the framework 8 and the first alignment indicia is a fluorescent fiber 9.

There are numerous or unlimited elements or combinations of elements that can be used as the two alignment indicia within the contemplation of this invention, with but a few examples shown in FIGS. 13 through 16.

Figure 13:
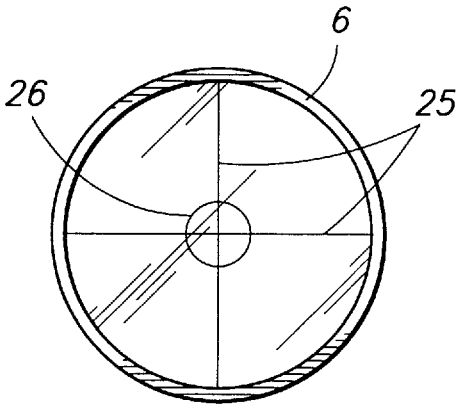
FIG. 13 is a front view of one example of the aiming alignment look that can be used for aligning the archer's eye with the sights on the bow, within the contemplation of this invention.

FIG. 13 illustrates an example of alignment indicia which combines a cross hair element 25 with a circle indicia 26, the archer being required to center the cross hair intersection with the circle indicia 26, preferably in the center of the circle indicia 26, to arrive at the correct eye position and alignment, i.e. viewed in the predetermined way.

Figure 14:
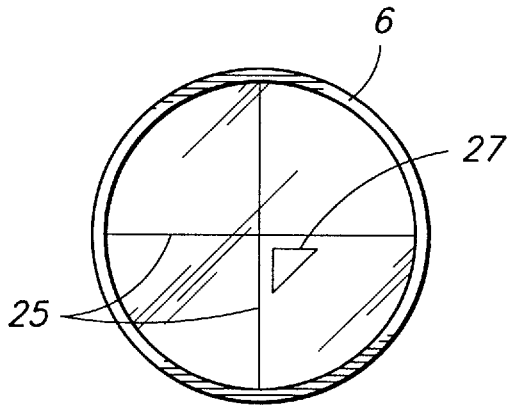
FIG. 14 is a front view of one example of the aiming alignment look that can be used for aligning the archer's eye with the sights on the bow, within the contemplation of this invention.

FIG. 14 illustrates another example of alignment indicia which combines a cross hair element 25 with an arrow or triangle 27, the archer being required to locate the point of the arrow or of the triangle 27 at or approximately at the cross hair intersection to arrive at the correct eye position and alignment. This would be the predetermined way to view the first alignment indicia and the second alignment indicia in this example.

Figure 15:
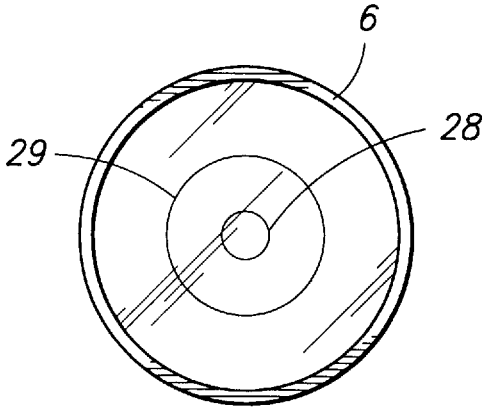
FIG. 15 is a front view of one example of the aiming alignment look that can be used for aligning the archer's eye with the sights on the bow, within the contemplation of this invention.

FIG. 15 illustrates another example of alignment indicia which combines concentric circles, i.e. a smaller diameter circle 28 with a larger diameter circle 29, the archer being required to place or center the smaller diameter circle 28 within the larger diameter circle 29 to arrive at the correct eye position and alignment. This would be the predetermined way to view the first alignment indicia and the second alignment indicia in this example.

Figure 16:
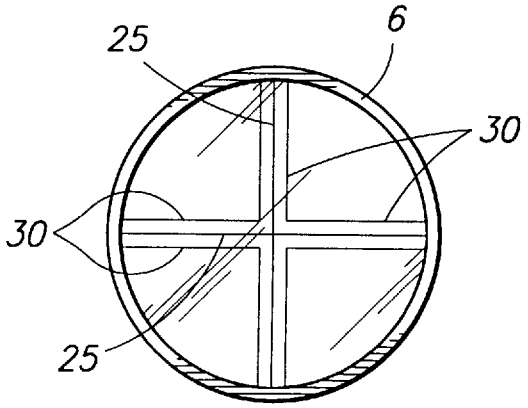
FIG. 16 is a front view of one example of the aiming alignment look that can be used for aligning the archer's eye with the sights on the bow, within the contemplation of this invention.
Figure 11:
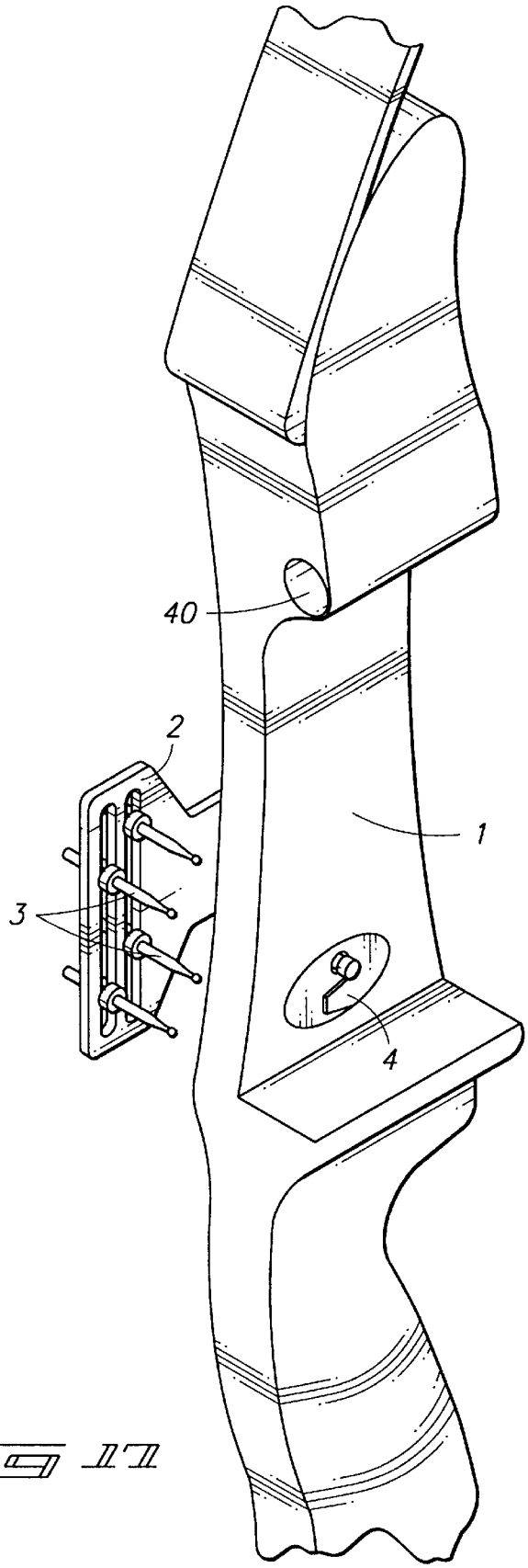

FIG. 16 illustrates another example of alignment indicia which combines a first narrower cross hair 25 configuration with a second wider cross hair configuration 30, the archer being required to place or center the narrower cross hair 25 within the larger second cross hair configuration 30 to arrive at the correct eye position and alignment. This would be the predetermined way to view the first alignment indicia and the second alignment indicia in this example. Lens mount 6 is also illustrated in FIGS. 13–16.

FIG. 17 illustrates an embodiment of the eye alignment apparatus as it may be installed in the bow itself and a location 40 in the bow into which the eye alignment apparatus may be installed.

Figure 18:
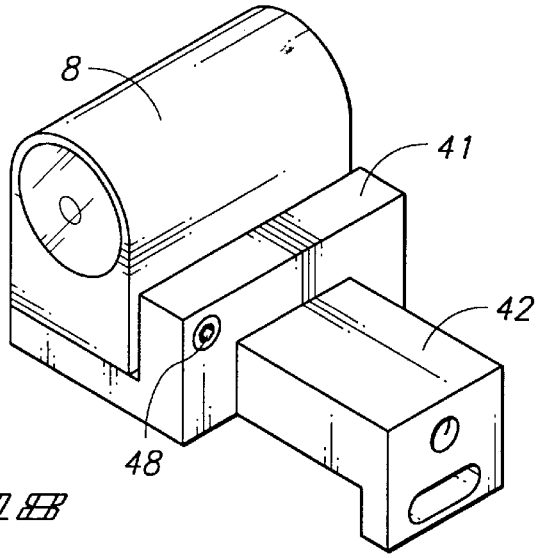
FIG. 18 is a perspective view of one example of an adjustably mounted eye alignment apparatus contemplated by this invention.

The eye alignment apparatus provided by this invention can also be directly or indirectly mounted in or on the bow, in an adjustable way so that the archer can easily make adjustments to the angle of the apparatus, and FIG. 18 illustrates one way to accomplish the adjustable feature.

FIG. 18 is a perspective view of one example of an adjustably mounted eye alignment apparatus contemplated by this invention, illustrating the framework 8, a framework platform 41 and a framework mount 42.

Figure 19:
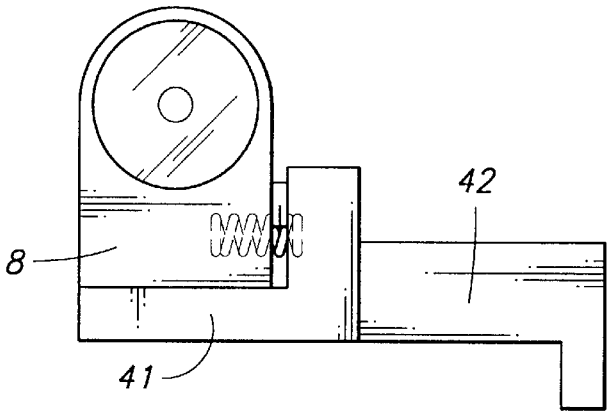
FIG. 19 is a front elevation view of one example of an adjustably mounted eye alignment apparatus contemplated by this invention.

FIG. 19 is a front elevation view of the adjustably mounted eye alignment apparatus shown in FIG. 18, and further illustrates the framework 8, framework platform 41 and framework mount 42.

Figure 20:
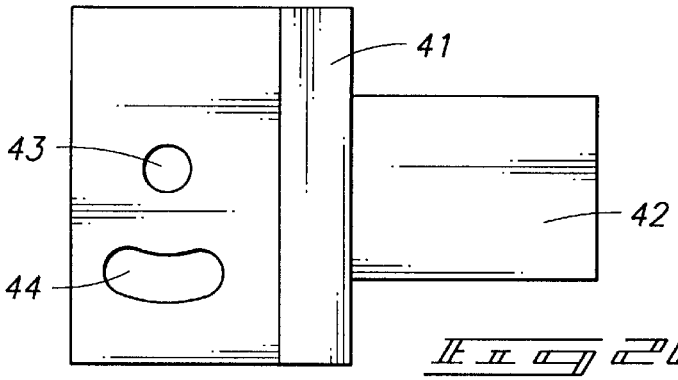
FIG. 20 is a top view of one example of the mount mechanism of an adjustably mounted eye alignment apparatus contemplated by this invention.

FIG. 20 is a top view of one example of the framework platform 41 and framework mount 42, illustrating hole 43 and hole 44, through which screws adjustably secure the framework 8 to the framework platform 41.

Figure 21:
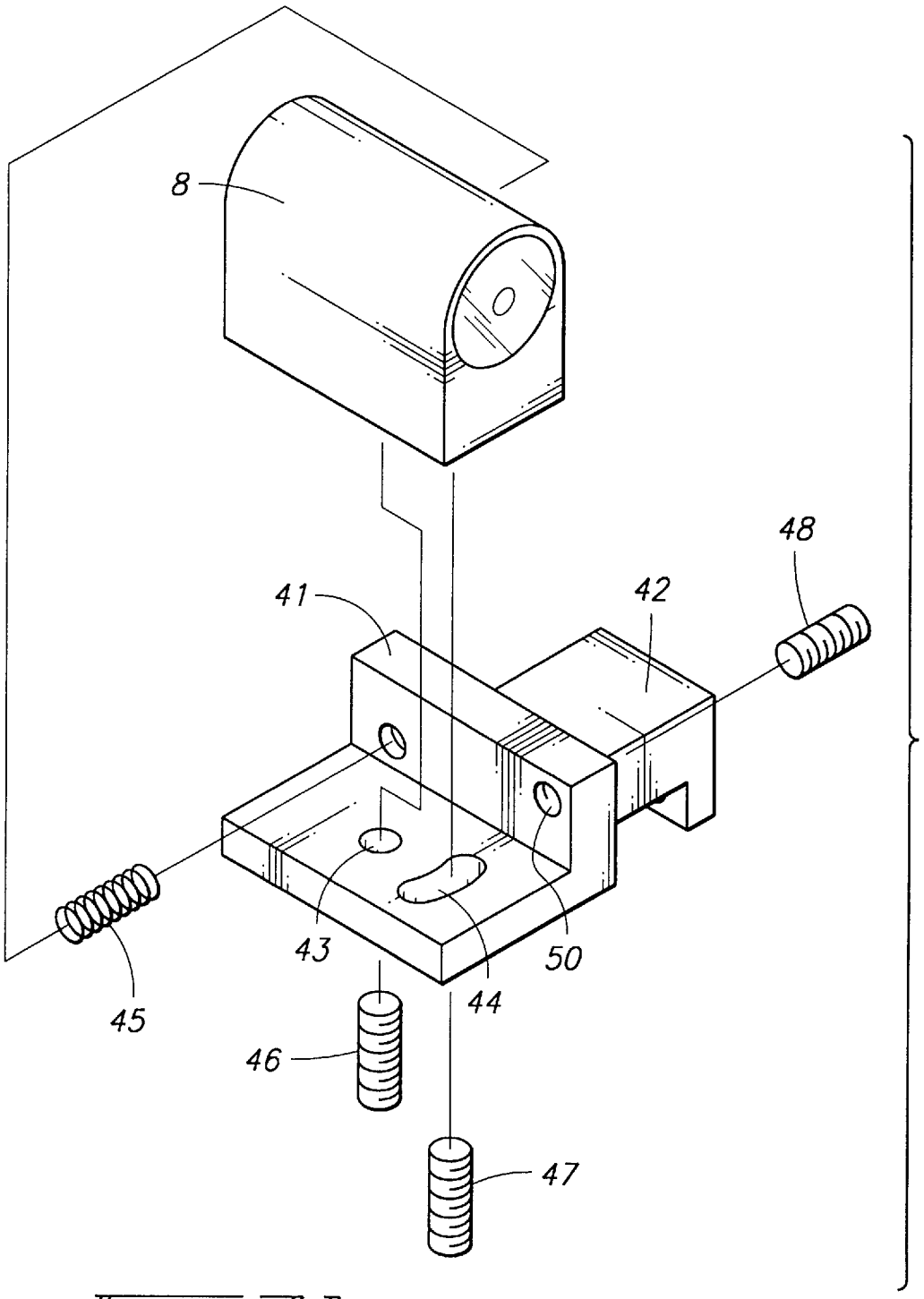
FIG. 21 is an exploded perspective view of one example of an adjustably mounted eye alignment apparatus contemplated by this invention.

FIG. 21 is an exploded perspective view of the adjustably mounted eye alignment apparatus and illustrates the various components and how they are related, assembled and how they interact. Screw 46 penetrates through hole 43 and into framework 8, serving as an axis of rotation for the framework 8. Screw 47 penetrates through elongated hole 44 and into framework 8, serving as the means to secure the framework 8 at the desired angle.

FIG. 21 also shows spring 45 which is seated in framework platform 41 and in framework 8 to keep constant pressure on the framework 8. FIG. 21 further shows screw 48 which penetrates through hole 50 in the framework platform 41 and rotationally pushes on framework 8 in opposition to spring 45. Screw 48 allows easy adjustment to the angle of the framework 8.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. An eye alignment apparatus for attachment to an archery bow, comprising:

a. a framework;

b. a lens mounted to the framework;

c. a first alignment indicia mounted to the framework and spaced apart from the lens;

d. a second alignment indicia mounted at the lens; and wherein the first alignment indicia and the second alignment indicia can only be viewed in a predetermined way from a predetermined approximate angle.

2. An eye alignment apparatus as recited in claim 1, and in which the second alignment indicia is mounted on the lens.

3. An eye alignment apparatus as recited in claim 1, and in which the first alignment indicia is comprised of fluorescent light gathering fiber.

4. An eye alignment apparatus as recited in claim 1, and which further comprises a bow attachment mechanism on which the eye alignment apparatus framework is mounted.

5. An eye alignment apparatus as recited in claim 1, and which further comprises a level indicator mounted to the framework.

6. An eye alignment apparatus as recited in claim 1, and in which the framework is tubular.

* * * * *